United States Patent [19]

Fogel

[11] 4,192,031

[45] Mar. 11, 1980

[54] WATERBED MATTRESS

[75] Inventor: Isaac Fogel, Silver Spring, Md.

[73] Assignee: Classic Corporation, Jessup, Md.

[21] Appl. No.: 3,820

[22] Filed: Jan. 16, 1979

[51] Int. Cl.[2] ..... A47B 27/08; A47B 27/14

[52] U.S. Cl. ..... 5/451; 5/481

[58] Field of Search ..... 5/349, 350, 368, 369, 5/370, 371, 451, 452, 457, 458, 481

[56] References Cited

U.S. PATENT DOCUMENTS 3,736,604 6/1973 Carson, Jr. ..... 5/370

*Primary Examiner*—Alexander Grosz

*Attorney, Agent, or Firm*—Leitner, Palan, Martin & Bernstein

[57] ABSTRACT

A waterbed mattress construction includes baffle means for dampening water wave action. The dampening means comprises one or more flexible plastic strips welded to the interior bottom surface of the mattress and flotation means welded to the other end of the strips. The flexible strips may be in the form of an open box with approximately the same configuration as the waterbed mattress. The flotation means is a single piece of foam or other material which causes the plastic strips to float to the top of the water in the mattress.

5 Claims, 6 Drawing Figures

WATERBED MATTRESS

BACKGROUND OF THE INVENTION

The present invention relates to a waterbed mattress and, more particularly, to a waterbed mattress which has internal vertical baffle means for reducing water wave action within the mattress.

Although waterbeds of various constructions have become extremely popular in recent years, many individuals have purchased waterbeds and have been dissatisfied with them. The water mattress, which is basically a non-form retaining bag filled to capacity with water, exhibits a resonant frequency phenomenon related to the size of the bag and the mass of the water. Many individuals find this resonant characteristic disruptive of sleep or other pursuits.

A waterbed mattress is supported on four sides. With the advent of waterbeds, a special frame structure was developed to support a water-filled mattress. Generally, the most commonly used structure includes a platform or pedestal which raises the height of the mattress to the level of a conventional bed. The pedestal may be of any structural design. Usually, commercial pedestals are somewhat smaller in dimensions than the mattress and the supporting frame. The waterbed frame, therefor, may extend beyond the pedestal as much as a foot on all four sides. The waterbed frame includes a decking board, which rests on the pedestal, and an upstanding frame structure that includes rails. A waterbed mattress is supported on the decking board and within the upstanding frame. The pedestal and frame combination provides a basic unit which can be used for contemporary or traditional decor.

The most popular mattress size is the queen size which measures 60×84 inches. A queen size waterbed mattress which is 9 inches deep will hold approximately 187 gallons of water. A person lying on a waterbed mattress which holds that much water will create a transverse wave action each time he shifts his body weight. Once the water is set into motion, a resonant frequency develops which strikes the sides of the supporting frame of the bed and returns in the opposite direction. Any continuous movement will cause a larger resonant frequency which would require several minutes to dissipate.

There have been prior attempts to alleviate the problem of resonant frequencies created from water wave action in waterbed mattresses. One of the most common solutions is to reduce the thickness or height of the waterbed mattress by cushioning it with foam pads. Tinnell, in U.S. Pat. No. 4,015,299, discloses such a waterbed construction. Even though the construction shown by Tinnell is intended to reduce resonant frequencies, it is highly likely that there will be a substantial amount of resonant frequency. Furthermore, the Tinnell construction requires the use of a substantial amount of foam padding, which increases the cost of the mattress.

Labianco, in U.S. Pat. No. 3,840,921, shows a waterbed mattress construction having a pair of parallel internal baffles which are joined to the interior top and bottom surfaces of the mattress. Each baffle extends for a major portion of the length of the mattress, and thereby forms separate parallel chambers within the mattress. The ends of the chambers are in intercommunication adjacent to the ends of the mattress. This baffle arrangement allows water in the mattress to swirl from one chamber to the next. While the use of baffles is superior to other solutions for reducing water wave action and the inherent resonant frequency associated therewith, the fact remains that baffles arranged parallel to each other with intercommunication at each end of the mattress will not arrest the wave action in a short period of time. The swirling water at each end of the mattress does not dampen the wave action. In fact, the transverse wave action in combination with the swirling water creates stresses on the baffles where they are joined to the interior top and bottom surfaces. Quite often these stresses pull the baffles loose from the mattress, thereby destroying the dampening effect and in many cases the mattress as well by tearing the top or bottom surface to which they are sealed. The Labianco baffle arrangement is intended to be used with a waterbed frame having inclined walls such that some of the wave action bulges the mattress over the end of the frame to take up some of the resonant frequency, which is entirely different from the present invention which uses a regular waterbed frame without inclined walls.

Carson et al, in U.S. Pat. No. 3,736,604, disclose a waterbed mattress including baffles suspended from the interior top surface. The baffles are bottom weighted to resist water wave action. The baffles also have holes to provide a restricted communication between the chambers formed by the baffles. The baffles run lengthwise and crosswise, with the crosswise baffles spaced between the lengthwise baffles. The Carlson et al baffle arrangement sets up relatively stationary walls across the mattress, since the crosswise baffles interfere with any movement of the lengthwise baffles. The baffles being weighted and suspended from the top interior surface of the mattress and having communication holes are limited in maintaining a smooth wiping action with the bottom interior surface, which wiping action is important in dampening any wave action in a short period of time.

SUMMARY OF THE INVENTION

According to the present invention, there is provided a waterbed mattress which includes a top sheet and a bottom sheet with baffle dampening means attached to the interior of the bottom sheet and extending vertically to contact the interior of the top sheet. The baffle dampening means comprises (1) a piece of material having slightly smaller dimensions than the waterbed mattress and made of a material, such as polyethylene foam, which floats in water and (2) strips of plastic attached along one end to the material and at the other end to the interior of the bottom sheet.

DETAILED DESCRIPTION OF THE DRAWINGS

Figure 1:
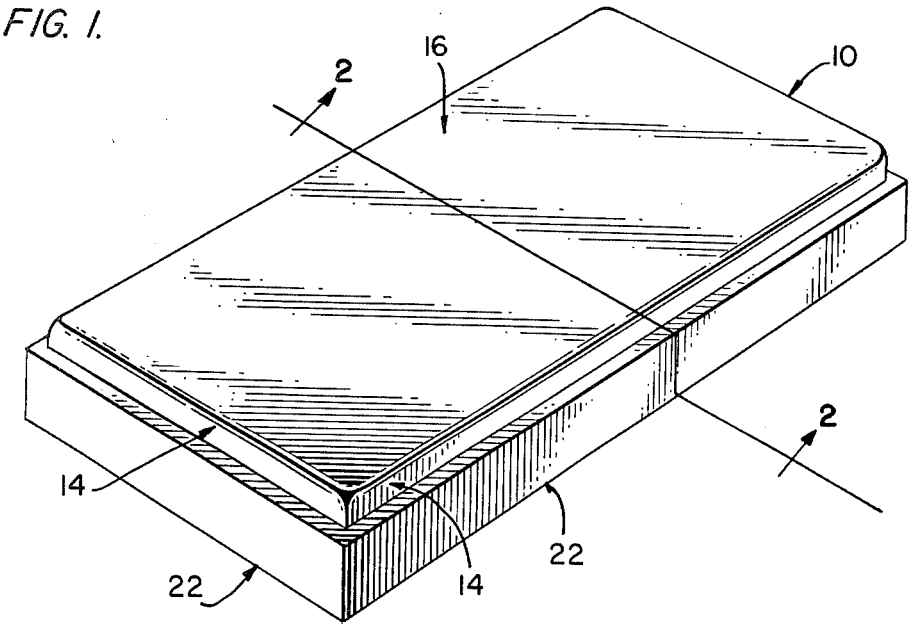
FIG. 1 is a perspective view of one embodiment of a waterbed mattress according to the present invention.

Referring to the drawings and, in particular, to FIG. 1, there is shown a waterbed mattress according to the present invention which includes a sturdy rectangular waterbed mattress shell 10 of vinyl, polyethylene, or a similar impervious synthetic plastic material. The waterbed mattress shell 10 is similar in length and width to the frame structure of a single, full, queen, or king size waterbed which usually includes a pedestal, a decking board, and upstanding peripheral rails.

Figure 3:
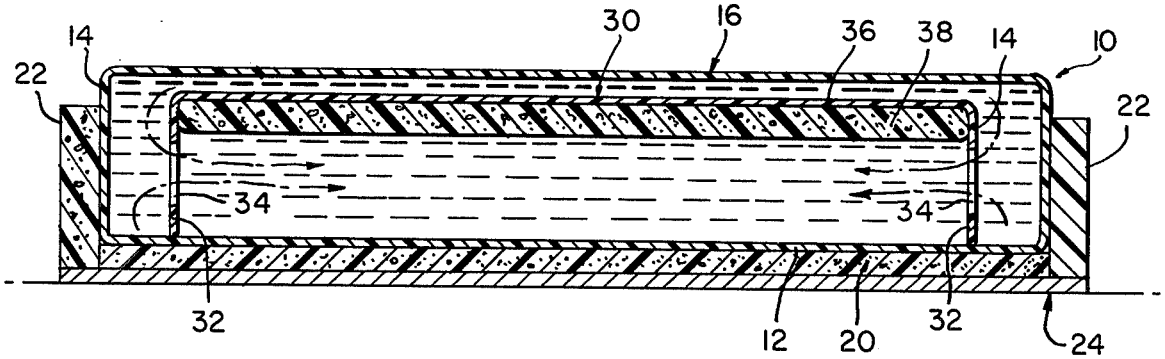
FIG. 3 is a sectional view taken along the line 2—2 of FIG. 1 showing the baffle dampening means of the invention.

A sectional view of a typical waterbed frame structure is shown in FIG. 3 wherein the waterbed frame structure has a planar surface decking board 20 and upstanding peripheral rails 22. The upstanding peripheral rails 22 are secured to the decking board 20 by mechanical fasteners, such as screws or nails, or by a permanent adhesive. When secured together, the decking board 20 and upstanding rails 22 form an open-box-like structure with a cavity area. The completed decking board/upstanding rails structure is placed on a pedestal 24 to raise the waterbed above the floor. The pedestal 24 may be constructed to have a rectangular frame with an interconnecting grid of supporting slats. The waterbed frame does not form a part of the present invention.

Figure 5:
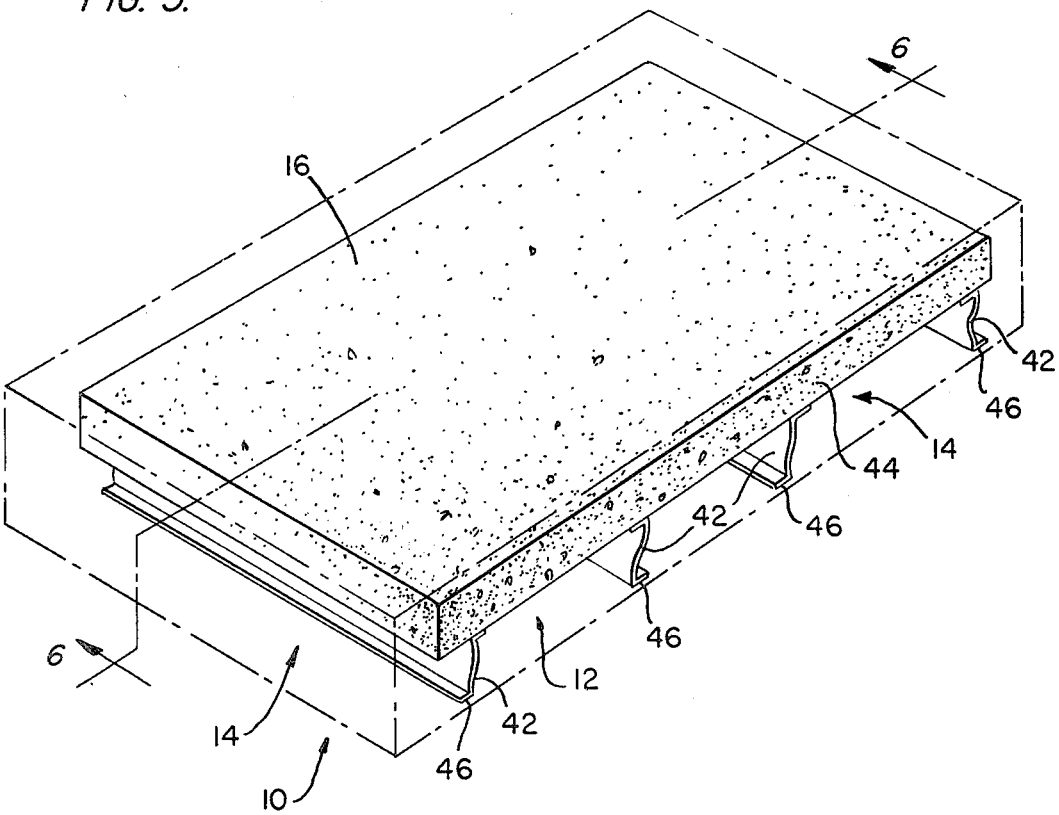
FIG. 5 is a perspective view of another embodiment of a waterbed mattress according to the present invention.

In FIGS. 1, 3, and 5, the waterbed mattress has a bottom wall 12, a top wall 16, and peripheral vertical walls 14. The mattress shell is formed by double heat welding the top and bottom walls to the peripheral vertical walls.

Figure 2:
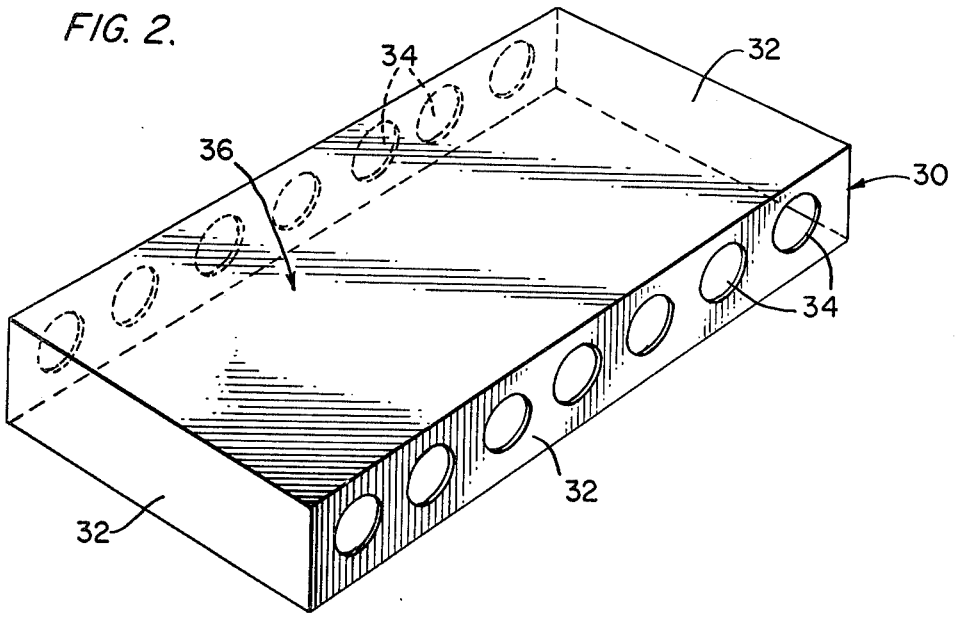
FIG. 2 is a perspective view of one embodiment of the baffle means of the present invention.
Figure 4:
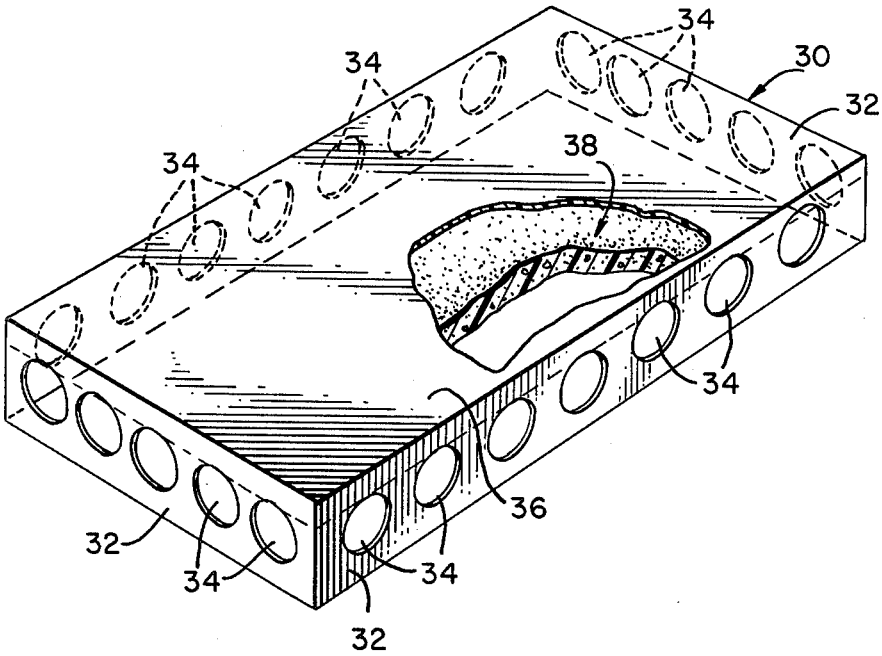
FIG. 4 is a perspective cutout view of the baffle means of the present invention.

The dampening means of the invention are shown in FIGS. 2, 3, and 4, at 30.

FIG. 3 shows the dampening means 30 in position inside the waterbed mattress.

Referring to FIG. 2, the dampening means comprises four sheets of flexible, water-impervious material 32, such as polyvinyl chloride or polyethylene, to form the sides of an open box having the approximate shape of the waterbed mattress 10 and smaller dimensions than the waterbed mattress 10. Openings 34 in the water-impervious material permit water to flow through the walls of the dampening means. These openings 34 may be located only in two opposite walls 30 of the dampening means as shown in FIG. 2, or may be located in all four walls of the dampening means, as shown in FIG. 4. The top sheet of the dampening means, 36, is also made of a flexible, water-impervious material, such as polyvinyl chloride or polyethylene, and is attached to all four sides of the open box 32 to form a box which is closed on the top and open on the bottom.

Referring to FIGS. 3 and 4, a material that floats in water 38 is attached to the underside of the top sheet 36 of the dampening means to cause the top sheet 36 to float in the water used to fill the waterbed mattress. This material 38 may be foam, such as polyurethane, polyethylene foam or styrofoam. Alternatively, the flotation material may be an air-filled bladder attached to the underside of the top sheet 36.

The baffle means 30 is attached by thermal welds along the bottom of the baffle means to the inside lower interior surface of the bottom wall 12 of the waterbed mattress shell 10.

Since the flotation material 38 floats in water, the dampening means 30 will extend the vertical distance between the interior top surface wall 16 and the interior bottom surface wall 12 of the water filled waterbed mattress. In the preferred embodiment, the top surface 36 of the dampening means is in partial contact with the interior inside surface of top wall 16 to create a wiping action which has been found to be beneficial in preventing water wave action. Since wave action is created by a person's movement forcing the water transversely across the waterbed mattress, the dampening means 30 achieves substantially complete dampening of the waves when in contact with the interior surface of the top wall 16. This is because, as the waves push against the side walls 32 of the dampening means, the walls flex in the direction of the wave force at a slow rate due to the flotation material 38, thereby maintaining a wiping action against the interior surface of top wall 16. If the wave force is great enough there is a momentary slight separation of the dampening means 30 from the interior surface of the top wall 16. However, the dampening means quickly recovers from the separation due to flotation means 38 to again form a wiping contact seal against further wave action.

While it is preferred to have the dampening means 30 in constant wiping contact with the interior surface of wall 16, wiping contact can be achieved by a person's weight forcing the top wall 16 downward against the dampening means 30. Therefore, it is possible to have a slight separation between the dampening means 30 and the interior surface of wall 16 as shown in FIG. 3.

Figure 6:
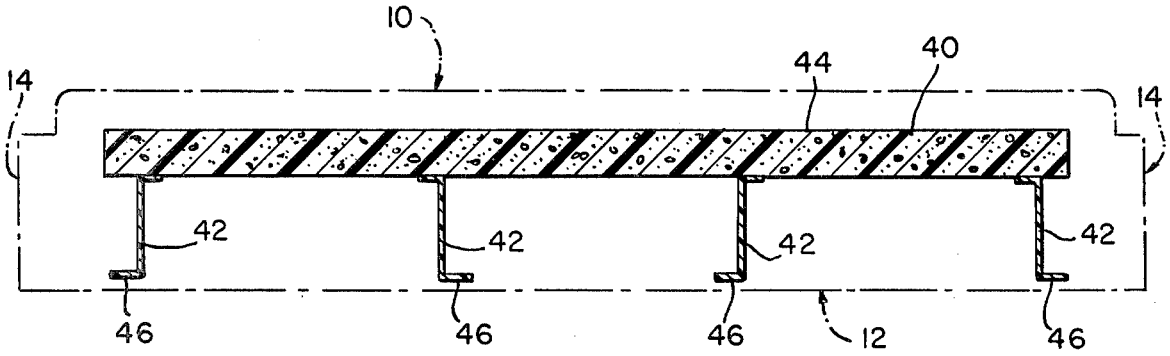
FIG. 6 is a sectional view taken along the line 6—6 of FIG. 5 showing the baffle dampening means of the invention.

Referring to FIGS. 5 and 6, the waterbed mattress 10 has a bottom wall 12, a top wall 16, and peripheral vertical walls 14. As in FIGS. 1–4, the mattress sheet is formed by double heat welding the top and bottom walls to the peripheral vertical walls. The dampening means 40 includes one or more strips of flexible water-impervious material 42 such as sheets of polyvinyl chloride or polyethylene welded to the interior bottom wall 12 of the mattress, and flotation means 44 which is a single piece of foam or other material which causes the plastic sheets to float to the top of the water in the mattress. Flotation means 44 is preferably of approximately the same shape as the waterbed mattress with slightly smaller dimensions than the waterbed mattress. The plastic sheets 42 are attached by lower bent edge 46 to the inside lower interior surface of the bottom wall 12 of the waterbed mattress shell 10. Since the flotation means 44 floats in water, the dampening means 40 will extend the vertical distance between the interior top surface wall 16 and the interior bottom surface wall 12 of the water filled waterbed mattress.

In the preferred embodiment, the dampening means 40 is in contact with the interior surface of the top wall 16 to create a wiping action which has been found to be beneficial in preventing water wave action. Since wave action is created by a person's movement forcing the water transversely across the waterbed mattress, the dampening means 40 achieves substantially complete dampening of the waves when in contact with the interior surface of the top wall 16. This is because as the waves push against the dampening means 40, the flexible sheets 42 flex in the direction of the wave force at a slow rate due to the flotation means 44, whereby maintaining a wiping action against the interior surface of top wall 16. If the wave force is great enough, there is a momentary slight separation of the dampening means 40 from the interior surface of top wall 16. However, the dampening means quickly recovers from the separation due to the flotation means 44 to again form a wiping contact seal against further wave action.

While it is preferred to have the dampening means 40 in constant wiping contact with the interior surface of wall 16, wiping contact can be achieved by a person's weight forcing the top wall 16 downward against the top of the dampening means 44. Therefore, it is possible to have a slight separation between the dampening means 40 and the interior surface of wall 16, as shown in FIG. 6.

Although in FIGS. 5 and 6 the flexible sheets 42 are shown arranged parallel to each other, the flexible sheets may be arranged in any desired configuration. The flexible sheets 42 form temporary chambers which aid in dampening any water wave action.

Although only two specific forms of the waterbed mattress have been shown and illustrated in the drawings, it will be understood that various modifications and changes may be made by those skilled in the art without departing from the inventive concept. Therefore, reference should be made to the appended claims for a definition of the scope of the invention.

What is claimed is:

1. A waterbed mattress having dampening means for substantially eliminating water wave action comprising:

a. a top sheet, a bottom sheet, and peripheral vertical walls wherein the top sheet and the bottom sheet are joined to the peripheral vertical walls on their peripheral edges to form a sealed envelope; and b. dampening means in the waterbed mattress, the dampening means being affixed to the interior surface of the bottom sheet and having flotation means for extending the dampening means vertically, the dampening means being positioned in the waterbed mattress to prevent continuous water wave action;

c. the dampening means comprising:

(1) a box, open on the bottom, of flexible, water-impervious, sheet-like material, the open box having the approximate shape of the waterbed mattress;

(2) a plurality of openings located in two opposite vertical sides of the open box; and (3) flotation means attached to the underside of the top of the open box.

2. The waterbed mattress of claim 1 wherein a plurality of openings are located in all four vertical sides of the open box forming the dampening means.

3. The waterbed mattress of claim 1 wherein the dampening means maintains a substantially constant wiping contact with the interior of the top wall of the waterbed mattress.

4. The waterbed mattress of claim 1 wherein the flotation means is a single piece of foam.

5. The waterbed mattress of claim 4 wherein the foam has approximately the same horizontal dimensions as the waterbed mattress.

* * * * *